US006817155B2

(12) United States Patent
Larson

(10) Patent No.: US 6,817,155 B2
(45) Date of Patent: Nov. 16, 2004

(54) STRUCTURAL SHAPE FOR USE IN FRAME CONSTRUCTION

(75) Inventor: Jay W. Larson, Bethlehem, PA (US)

(73) Assignee: Steel Construction Systems, Orlando, FL (US)

( * ) Notice: Subject to any disclaimer, the term of this patent is extended or adjusted under 35 U.S.C. 154(b) by 0 days.

(21) Appl. No.: 10/643,311

(22) Filed: Aug. 18, 2003

(65) Prior Publication Data

US 2004/0050011 A1 Mar. 18, 2004

Related U.S. Application Data

(63) Continuation of application No. 09/264,991, filed on Mar. 17, 1999, now abandoned, and a continuation of application No. 08/950,343, filed on Oct. 14, 1997, now Pat. No. 5,865,008.

(51) Int. Cl.[7] ..... E04C 3/07

(52) U.S. Cl. ..... 52/690; 52/634; 52/639; 52/731.7; 52/92.1

(58) Field of Search ..... 52/690, 634, 639, 52/731.7, 92.1, 636, 729.1, 730.4, 732.1, 710, 365, 351, 696, 92.2; 521/729.3; 403/230, 232.1, 295

(56) References Cited

U.S. PATENT DOCUMENTS 1,311,486 A * 7/1919 Benedict ..... 52/737.2
2,284,898 A * 6/1942 Hartman ..... 52/654.1
2,541,784 A * 2/1951 Shannon ..... 52/92.2
2,642,825 A * 6/1953 Mcelhone et al. ..... 52/641
3,656,270 A * 4/1972 Phillips ..... 52/693
3,785,108 A * 1/1974 Satchell ..... 52/645
4,389,829 A * 6/1983 Murphy ..... 52/693
4,435,940 A * 3/1984 Davenport et al. ..... 52/641
4,551,957 A * 11/1985 Madray ..... 52/93.2
4,616,453 A * 10/1986 Sheppard et al. ..... 52/93.1
4,621,475 A * 11/1986 McClain ..... 52/693
4,644,728 A * 2/1987 Stauss et al. ..... 52/710
4,748,784 A * 6/1988 Dividoff et al. ..... 52/639
4,798,037 A * 1/1989 Collins ..... 52/732.1

(List continued on next page.)

FOREIGN PATENT DOCUMENTS

GB 2222188 A 2/1990

*Primary Examiner*—Carl D. Friedman
*Assistant Examiner*—Nahid Amiri
(74) *Attorney, Agent, or Firm*—Harold I. Masteller, Jr.

(57) ABSTRACT

A structural section for use in frame construction where the section includes a horizontal segment and a pair of spaced apart legs. Each leg has a first end portion attached to the horizontal segment, a second end portion opposite the horizontal segment, and a flange that extends inward from the second end portion toward the centerline of the structural section. Each leg further includes a longitudinal surface located between the first end portion and the second end portion. The longitudinal surface is positioned inboard of the flange so that the distance between opposed flanges that extend along each leg of the structural section is greater than the distance between opposed longitudinal surfaces that extend along each leg of the structural section.

32 Claims, 4 Drawing Sheets

U.S. PATENT DOCUMENTS 4,809,476 A * 3/1989 Satchell ..... 52/241
4,878,323 A * 11/1989 Nelson ..... 52/92.2
4,982,545 A * 1/1991 Stromback ..... 52/639
4,986,051 A * 1/1991 Meyer et al. ..... 52/737.1
5,157,883 A * 10/1992 Meyer ..... 52/357
5,325,651 A * 7/1994 Meyer et al. ..... 52/715
5,417,028 A * 5/1995 Meyer ..... 52/737.6
5,457,927 A * 10/1995 Pellock et al. ..... 52/633
5,463,837 A * 11/1995 Dry ..... 52/639
5,499,480 A * 3/1996 Bass ..... 52/653.1
5,527,625 A * 6/1996 Bodnar ..... 428/595
5,535,569 A * 7/1996 Seccombe et al. ..... 52/634
5,542,227 A * 8/1996 Frayne ..... 52/639
5,577,353 A * 11/1996 Simpson ..... 52/92.2
5,927,041 A 7/1999 Sedlmeier et al.
6,073,414 A 6/2000 Garris

* cited by examiner

Fig. 1
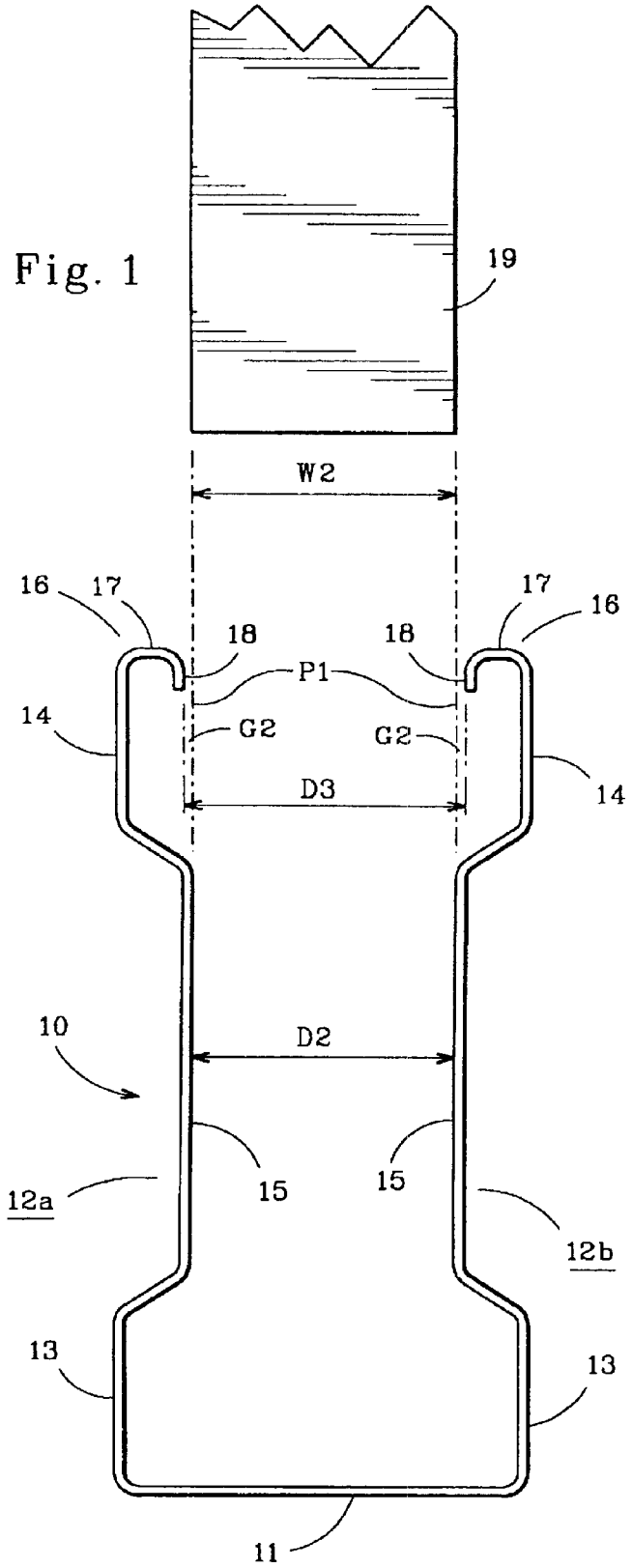
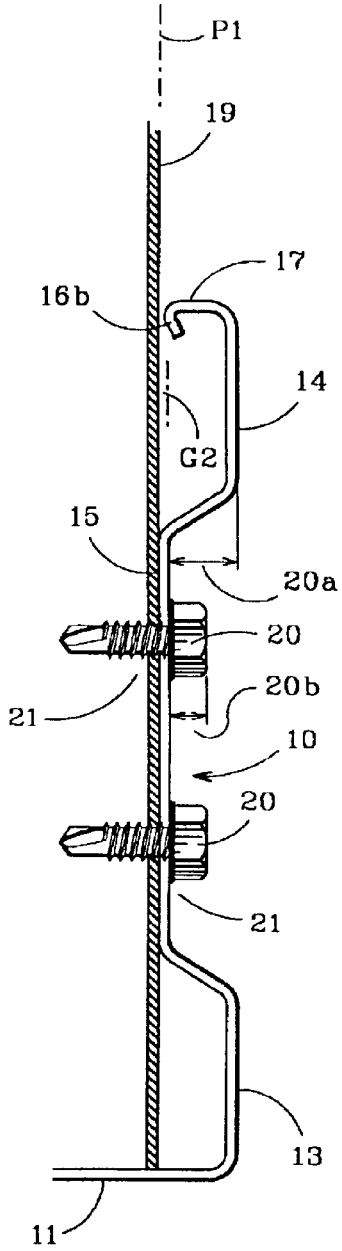
Fig. 1A

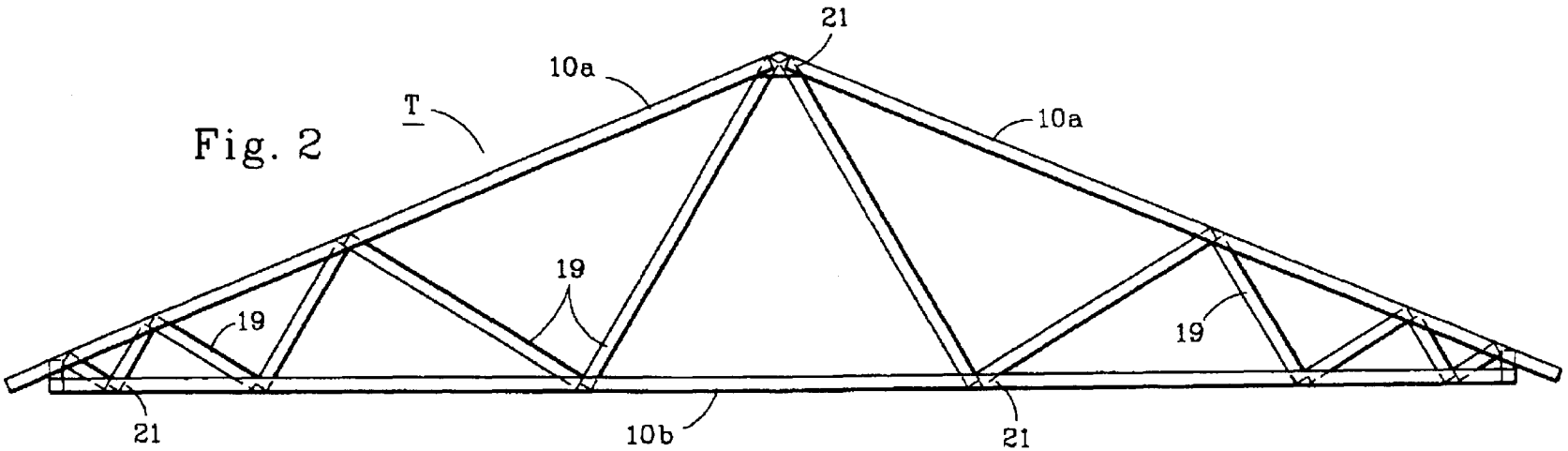
Fig. 2
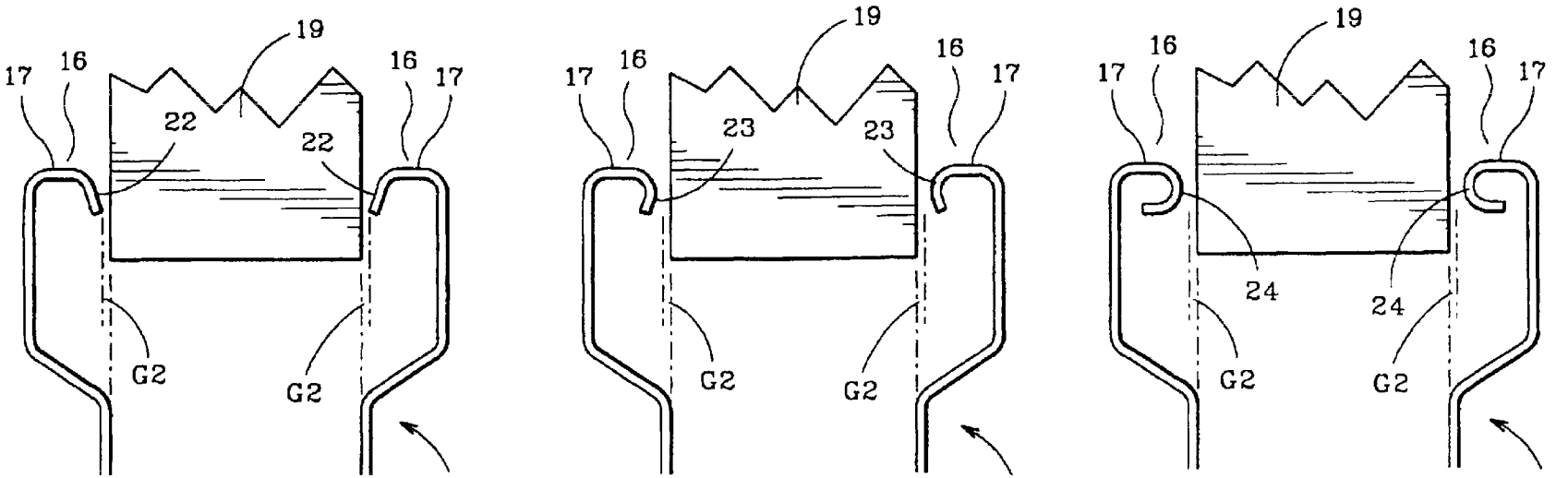
Fig. 3
Fig. 4
Fig. 5

W1
D1
A
P

STRUCTURAL SHAPE FOR USE IN FRAME CONSTRUCTION

This is a continuation of application Ser. No. 09/264,991 filed Mar. 17, 1999, now abandoned a continuation of application Ser. No. 08/950,343, Oct. 14, 1997 now U.S. Pat. No. 5,865,008.

This is a continuation of Ser. No. 08/950,343, Oct. 14, 1997, U.S. Pat. No. 5,865,008. This invention relates to roof trusses used in the construction industry to frame residential and light commercial buildings. More particularly, this invention is directed to the chord section that are used to assemble roof trusses used in lightweight steel frame construction.

BACKGROUND OF THE INVENTION

Wood is the predominant framing material used in residential and light commercial construction in the United States, However, builders, plagued by volatile and rising wood prices and poor quality as timber supplies shrink, continue to seek alternatives. Recent studies have identified steel as a promising alternative framing material to wood.

Various attempts have been made in the past to introduce lightweight, non-wood framing materials into the marketplace. These attempts include advanced composite materials such as fiber-reinforced plastic, as well as lightweight steel components such as doors, windows, siding and framing. However, history shows that whenever a new material becomes available to the construction industry, it is adopted cautiously, initially in small scale applications. Therefore, many of the newer wood substitute materials are not yet in wide use within the building industry. For example, in the instance of residential steel framing, acceptance has been slow because many builders have attempted to assemble lightweight steel framing using traditional wood construction techniques. Such wood construction methods drive up labor costs when applied to steel frame construction and make steel framing non-competitive with conventional wood frame construction. As a result, steel frame construction has gained only a small share of the home building marketplace as compared to wood frame homes. Steel frame construction tends to be concentrated mainly in areas where homes need to meet stricter structural demands to withstand natural phenomena such as earthquakes, high hurricane force winds, and pest problems such as termites.

However, with the adoption of new building techniques that include, for example, prefabricated steel frame panels delivered assembled to the construction site, and with the availability of new screw guns and fasteners that facilitate and improve steel frame connections, residential steel framing is gaining in popularity within the building industry. In particular, residential roof framing is one area that currently offers improved opportunities for using wood substitute construction materials. Manufactures have introduced an array of different non-wood roof framing products that range from steel roof panels, rafters and purlins, to prefabricated lightweight steel frame roof trusses designed to carry heavy loads over long spans.

The state-of-the-art for non-wood roof truss designs, is dynamic. Numerous different steel truss design improvements have taken place over a relatively short period of time, with many of these improvements directed to the shape of the structural sections used for the top and bottom chord members of the truss. It has been discovered, however, that, past steel truss chord sections present a plethora of problems for roof truss fabricator as well as for home builders.

For example, in FIGS. 6 and 13 of U.S. Pat. No. 4,435,940 to Davenport, et al., FIGS. 2 and 5 of U.S. Pat. No. 4,982,545 to Stromback, and in FIGS. 3 and 6 of U.S. Pat. No. 4,986,051 to Meyer, roof truss chord sections are shown comprising outward extending flanges. Such outward extending flanges stiffen and improve the strength of truss chords. However, outward extending flanges prevent the chords from lying flat during shipping and handling, and make it awkward to manufacture the roof truss. Additionally, outward extending flanges expose sharp sheet metal edges, and workers handling such chord sections must exercise extreme caution to avoid serious cuts, lacerations and other injuries.

U.S. Pat. No. 5,463,837 to Dry, teaches forming an outside hemmed edge along both legs of a truss chord. This would tend to protect workers from injury. The radiused hem edge eliminates the sharp edges associated with the outward extending flanges taught in the above three earlier patents. However, tests show that such hemmed edges greatly reduce the roof truss chord section properties to undesirable levels when compared to the outward extending flanges cited above.

Other lightweight steel frame sections teach providing an inward extending flange that maintains good section properties. For example, FIGS. 1, 3, 5, 7 and 9 of Meyer's U.S. Pat. No. 5,157,883, shows inward extending flanges. The 883 Meyer patent is directed to vertical studs used in lightweight steel framing. Another example of inward extending flanges, in a roof truss, is shown in FIGS. 4 and 7 of U.S. Pat. No. 4,982,545 granted to Strombach . While such inward extending flange sections would tend to reduce worker injury, maintain good section properties, and allow the sections to lie flat during roof truss fabrication, they create a new set of problems for the truss manufacturer.

A typical roof truss comprises a plurality of web members that extend between the top and bottom chord members of the truss. Each web member is inserted between the legs of the top chord and between the legs of the bottom chord member, and each truss web member is fastened to the chord members using self-drilling sheet metal screws that extend through the chord legs and into the web members or struts. In instances where the truss chord sections include inward extending flanges, prior to the present invention, it has been impossible to use self drilling screws or other simple fasteners to make the necessary truss chord-to-web connections. As clearly shown in the Meyer patent, the inward extending flanges create a large gap or space between the chord legs and inserted web member. Special connection hardware must be used to fasten the truss web members to the top and bottom truss chord members, as illustrated in FIG. 9 of Meyer, and such hardware is expensive to produce and time consuming to use.

In an attempt to overcome the aforementioned problems, one truss builder is manufacturing and selling a truss chord section that has inside hems formed along the top edge of both chord legs. The hems are formed with a tight radius in order to be coplanar with a corresponding leg surface that engages the truss web members that are inserted between the legs of the chord section. This roof truss design allows the truss chords to lie flat during roof truss fabrication, eliminates sharp sheet metal edges along the chord legs, and enables fabricators to make truss chord-to-web connections using self-drilling sheet metal screws. However, as stated above for the outside hems, tests show that hemmed edges produce very undesirable section properties in the truss chords. Additionally, in cases where the inside hems become deformed, whether during forming operations or during shipping and handling, deformed hems interfere with inserting the truss web members into the chord sections during fabrication of the roof truss. The chord legs must be pried apart to provide clearance between deformed hems, and this produces a gap between the truss web member and the chord leg that causes the self-drilling screws to fail to seat properly when the truss chord-to-web connections are made. Such defective connections are rejected if discovered during product quality inspection, or may fail prematurely if used under actual loading conditions.

SUMMARY OF THE INVENTION

Accordingly, it is a first object of the present invention to provide a structural shape comprising a horizontal segment extending between spaced apart legs and having no exposed sharp edges along the length thereof.

Another object of the present invention is to provide a structural shape having no outward projections that prevent the structural shape from lying flat along any one of its outside surfaces.

It is another object of the present invention to provide a truss chord-to-web connection where mechanical fasteners do not extend outside the periphery of the structural shape so that the assembled truss can lie flat along either of its outside surfaces.

It is another object of the present invention to provide a structural shape having inward pointing flanges extending along the spaced apart legs to improve section properties of the structural shape.

It is still another object of the present invention to provide a structural shape where the inward pointing flanges provide clearance for inserting truss web members between the spaced apart legs of the structural section during assembly.

It is still another object of the present invention to provide a structural shape where the inward pointing flanges that extend along the legs of the section facilitate connecting inserted truss web members without special connection hardware.

In satisfaction of the foregoing objects and advantages, the present invention provides a structural section for use in frame construction where the section includes a pair of spaced apart legs. Each leg has a first end portion attached to a horizontal segment, a second end portion opposite the horizontal segment, and a flange that extends or points inward from the second end portion toward the center line of the structural section. Each leg further includes a longitudinal surface located between the first end portion and the second end portion. The longitudinal surface is positioned inboard of the flange so that the distance between the opposed flanges that extend along each leg of the structural section is greater than a the distance between the opposed longitudinal surfaces that extend along each leg of the structural section.

BRIEF DESCRIPTION OF THE DRAWINGS

FIG. 1 is an end view of the preferred structural shape of the present invention FIG. 1A is a fragmentary view of FIG. 1 showing a deformed flange pointing inward from one of the legs.

FIG. 2 is an elevation view showing an exemplary roof truss manufactured using the structural shape of FIG. 1 as top and bottom roof truss chords.

FIG. 3 is a partial end view of the present invention showing an alternate flange embodiment.

FIG. 4 is a partial end view of the present invention showing a second alternate flange embodiment.

FIG. 5 is a partial end view of the present invention showing a third alternate flange embodiment.

DETAILED DESCRIPTION OF THE PREFERRED EMBODIMENT

Figures 6, 7, 8, 9, 10:
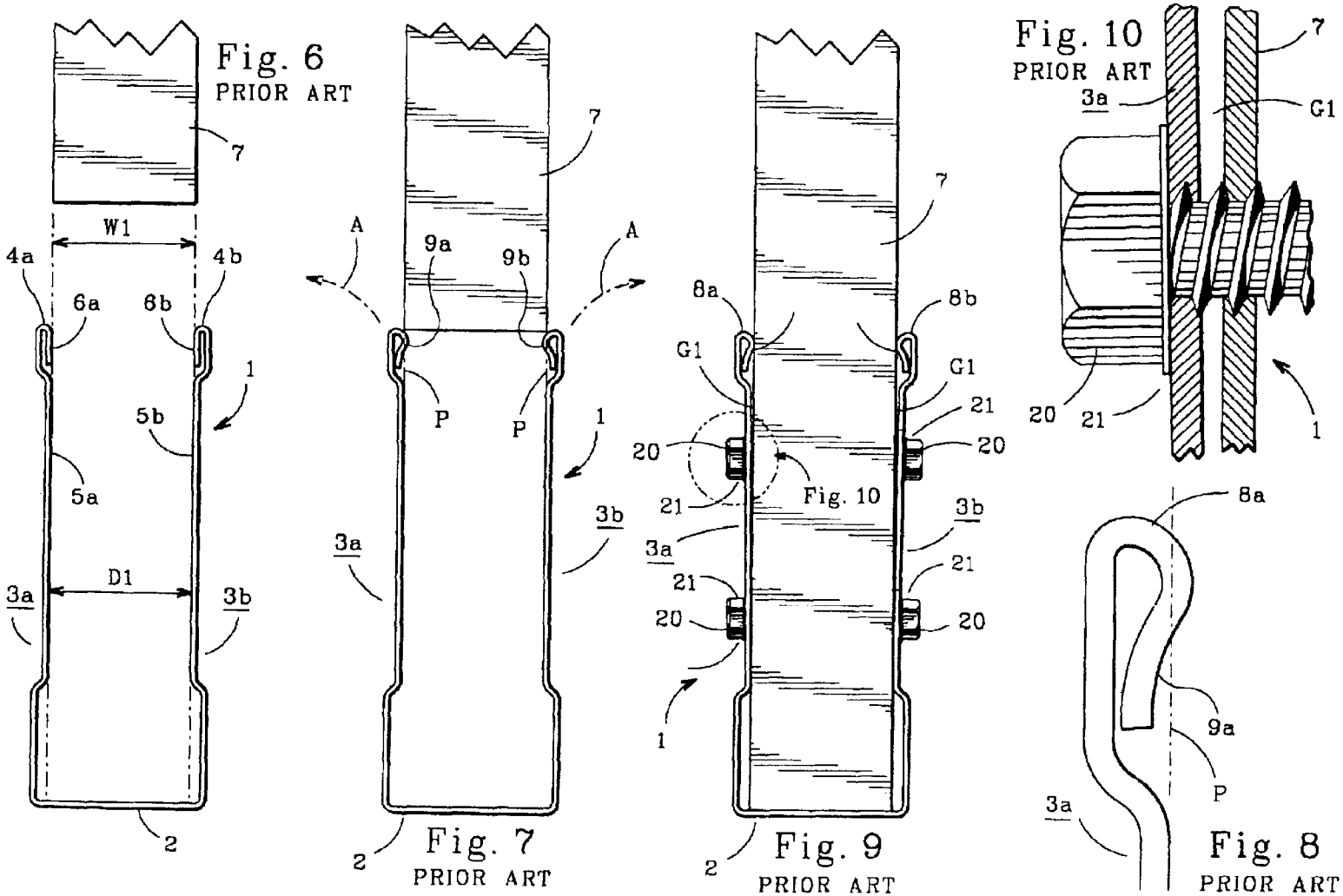
Fig. 6 PRIOR ART
Fig. 7 PRIOR ART
Fig. 8 PRIOR ART
Fig. 9 PRIOR ART
Fig. 10 PRIOR ART
FIG. 6 is an end view of a prior art roof truss chord having inside hemmed legs.
FIG. 7 is an end view similar to FIG. 6 showing deformed inside leg hems.
FIG. 8 is an enlarged view of FIG. 7.
FIG. 9 is a view of the roof truss chord in FIG. 7 showing a truss web member forced between the deformed leg hems.
FIG. 10 is an enlarged view of FIG. 9 showing a truss chord-to-web connection.

Referring to the end view labeled Prior Art in FIG. 6, the figure illustrates an elongated roof truss chord 1 as disclosed in a DALE/INCOR sales brochure entitled VERSA-TRUSS. Roof truss chord 1 includes a horizontal segment 2 and a pair of spaced apart legs 3*a* and 3*b* that include hemmed edges 4*a* and 4*b* formed along the upper end length of each leg. The spaced apart legs further include inside surfaces 5*a* and 5*b* that are positioned inward from the plane of legs 3*a* and 3*b* to engage truss web members 7 that are inserted between the legs 3*a* and 3*b* to fabricate a roof truss. The hems 4*a* and 4*b* include inside surfaces 6*a* and 6*b* that are coplanar with the inside surfaces 5*a* and 5*b*.

Distance "D1" between the leg surfaces 5*a* and 5*b* corresponds to outside width "W1" of the truss web members 7 that are inserted into the truss chord sections 1 during fabrication of a roof truss. Because the inside hem surfaces 6*a* and 6*b* are coplanar with surfaces 5*a* and 5*b*, the truss web members 7 would slide between the hems with very little extra effort as they are inserted between the legs of the roof truss chord. This coplanar alignment would permit fabricators to use self-drilling sheet metal screws, rivets, or mechanical clinching to connect the truss web members to the legs 3*a* and 3*b* of the chord section during fabrication of a roof truss.

However, small radius hems can be problematic during roll forming and they are often formed mis-shapened during manufacturing as shown in FIGS. 7 and 8 of the prior art roof truss chord. The drawing figures show that mis-shapened hems 8*a* and 8*b* may extend inward, beyond the plane "P" of the inside surfaces 5*a* and 5*b*. This is because the forming operation causes the metal to flow inward toward the center of the section as the hem is formed, and any excess metal or deformity is pushed toward the centerline of the rolled section. Hemmed edges can also be damaged and deformed during shipping and handling of a finished section product. In such circumstances, where the hemmed edges are either mis-shapened or deformed, the inside surfaces 9*a* and 9*b* are no longer coplanar with plane "P" of the inside surfaces 5*a* and 5*b*. This creates a problem for inserting the truss web members 7. It becomes very difficult to insert the truss web members into the truss chord without first prying and bending the chord legs apart as shown by the direction arrows "A" in FIG. 7. Such prying and pulling can create a varied assortment of problems during roof truss fabrication.

For example, prefabricated roof trusses are assembled on large layout tables that hold truss chord lengths of 10 feet and longer. It can be difficult to pry and bend chord legs apart to insert truss web members between mis-shapened, or damaged, or deformed hems. Additionally, when the truss web members 7 are finally forced between such hems and seated at their respective positions along the length of the chord, as shown in FIG. 9, the misalignment between the hemmed edges and the leg surfaces 5*a* and 5*b* creates a gap "G1" at the truss chord-to-web connection. As a result of this gap, when the self-drilling sheet metal screws 20, or other suitable fasteners are driven through the members to make the truss chord-to-web connection 21, it is impossible to draw the two pieces together, as shown in the enlarged view of a connection in FIG. 10, without distorting the chord section. Such poor connections are structurally unsound. On the one hand, for example, if the fasteners fail to close the gap at truss chord-to-web connection, the "open" connection can induce bending forces in the fastener or cause the fastener to tilt. On the other band, if the fastener is tightened to close the gap at the truss chord-to-web connection, the additional force required to distort the chord section can overload the fastener and weaken the connection. In such cases, overloaded fasteners can either break, or the fasteners can rip or tear through the sheet metal connections and cause structural failure.

Referring now to FIG. 1 of the drawings, the preferred embodiment of the present invention overcomes the aforementioned problems by providing a structural section 10 that comprises a horizontal segment 11 and a first leg 12*a* spaced apart from a second leg 12*b*. Each leg includes a lower or first end portion 13 attached to horizontal segment 11, an upper or second end portion 14, and a longitudinal surface 15 located between the lower end portion 13 and the upper end portion 14 of each respective leg 12*a* and 12*b*. The longitudinal surfaces 15 are positioned inboard of their respective first and second end portions 13 and 14, and the surfaces 15 are spaced apart a distance "D2" equal to the outside dimension "W2" of truss web members or struts 19 that are inserted between the spaced apart legs during assembly operations. This permits the spaced apart longitudinal surfaces 15 to engage the truss web members inserted between the legs 12*a* and 12*b* of the structural section.

Each end portion 14 of the structural section 10 comprises a longitudinally extending flange 16 that extends or points inward from the respective legs 12*a* and 12*b* toward the centerline of the structural section 10. Each flange includes a flat or planar segment 17 that communicates with its respective leg 12*a* or 12*b* and terminates in a downward pointing leg 18 perpendicular to the flat segment 17. Flanges 16 extend inward from legs 12*a* and 12*b* to a position that places the downward pointing legs 18 outboard of their respective longitudinal surfaces 15. This provides a gap "G2" between the longitudinal surfaces 15 and their corresponding flanges 16.

As clearly illustrated in FIG. 1, the spaced apart distance "D3" between the opposite flanges 16 is greater than the spaced apart distance "D2" between the opposite longitudinal surfaces 15. This difference in distances provides the gap "G2" that enables structural section 10 to overcome many of the fabrication and fastening problems described above in the prior art shown in FIGS. 6–10. For example, FIG. 1A shows a deformed flange 16*b* extending along a portion of leg 12*b* of the preferred embodiment. However, because the predetermined gap "G2" provides a clear space, the deformed flange 16*b* does not extend past the plane "P1" of longitudinal surface 15. The predetermined gap "G2" extends along the length of the structural section 10 in the event a flange is deformed anywhere along the section length. Therefore, gap "G2" provides a clearance for proper alignment of the truss web member or strut even when the flanges 16 of the chord member become mis-shapened, and the gap also provides for proper seating of fasteners 20 at the truss chord-to-web connections 21, along the full length of the structural section.

Referring once again to FIG. 1A, the longitudinal surfaces 15 are spaced inward from the lower and upper end portions 13 and 14 a distance 20*a* that is greater than the head thickness 20*b* of the fasteners 20 used to make the truss chord-to-web connection. This arrangement recesses the fasteners below the surface of the section legs 12*a* and 12*b* and enables the assembled truss to lie flat during shipping and handling, and protects the fasteners from damage.

It should be understood, however, that although the preferred embodiment shows flanges 16 comprising a planar segment 17 that terminate in a downward point end leg 18, other equivalent inward pointing flange shapes can be used without departing from the scope of this invention. For example, referring to FIG. 3, an equivalent structural section 10 is shown including spaced apart flanges 16 that are similar to the flanges of the preferred embodiment. In this case, however, the flat or planar portion 17 terminates in a downward pointing leg 22 that is sloped toward the centerline of the structural section at a position that will provide the necessary gap "G2" for proper alignment and fastening in the event a flange is deformed.

Likewise, a second alternate embodiment is shown in FIG. 4 comprising a structural section 10 having spaced flanges 16 similar to the flanges of the preferred embodiment. In this second case the planar portions 17 terminate in downward pointing legs 23 that slope outward away from the centerline of the structural section at a position that provides the necessary gap "G2" for proper alignment and fastening in the event a flange is deformed.

Similarly, a third equivalent embodiment, shown in FIG. 5, comprises a section 10 having spaced flanges 16 comparable to the flanges of the preferred embodiment. In this last example the planar portions 17 terminate in curvilinear legs 24 that are positioned to provide the necessary gap "G2" for proper alignment and fastening in the event a flange is deformed.

Any of the flange arrangements shown in FIG. 1 and FIGS. 3–5, or any other equivalent flange arrangement that provides the necessary gap "G2" is suited for use as a chord section in assembling the exemplary roof truss "T" shown in FIG. 2. Roof truss "T" comprises a top and bottom chord section 10*a* and 10*b* respectively. Truss web members or struts 19 extend between the top and bottom chord sections and the web members are attached to the chords at the connections 21 as described above.

Figure 13:
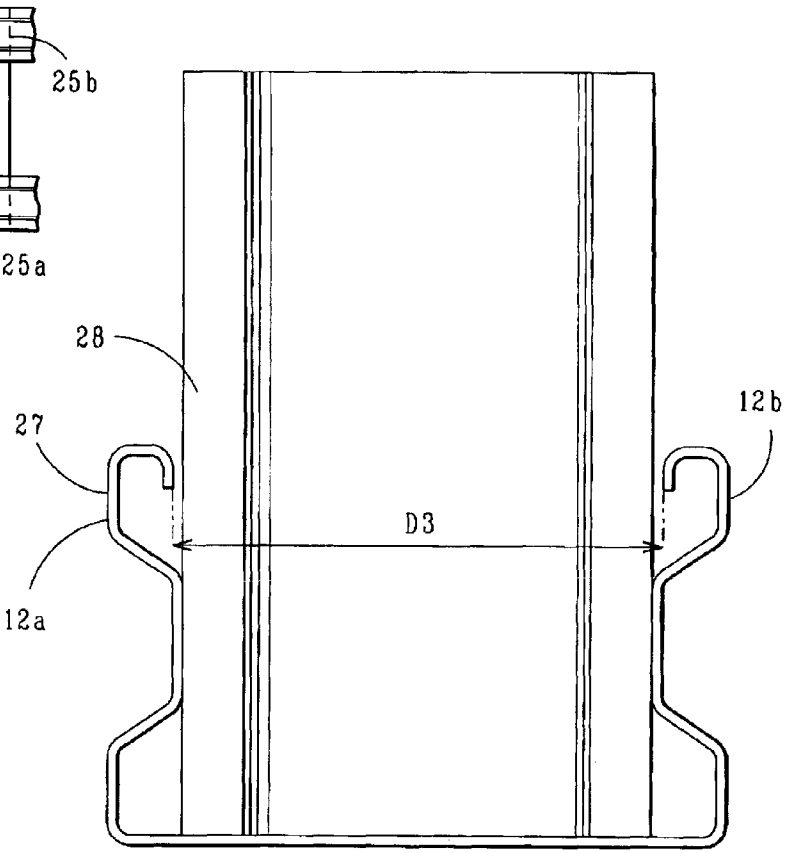
FIG. 13 is an elevation view showing the structural section of the present invention used as a track member and a wall stud member in a steel framing system.
Figure 11:
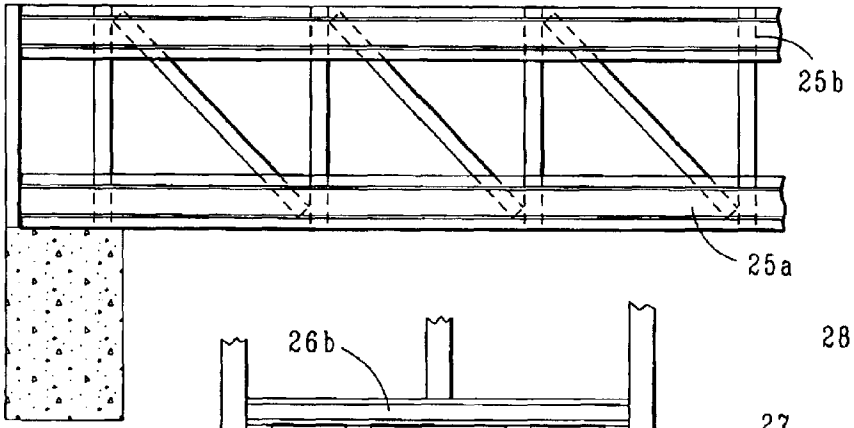
FIG. 11 is an elevation view showing the structural section of the present invention used as a cord member in a floor truss.
Figure 12:
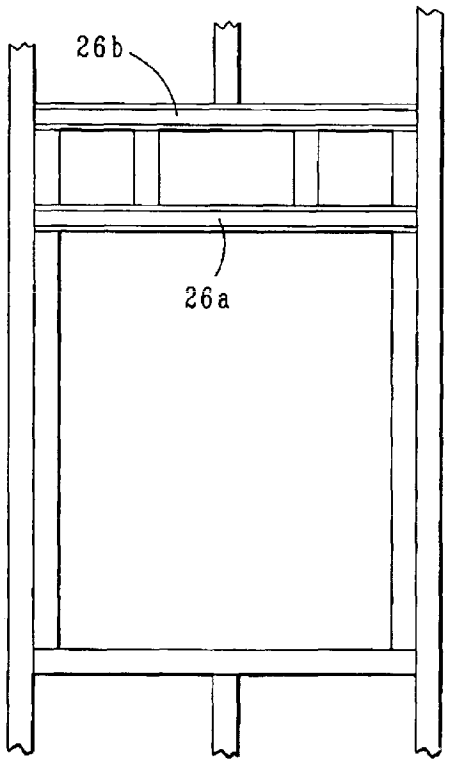
FIG. 12 is an elevation view showing the structural section of the present invention used as a chord member in a header.

However, it should be understood that the structural shape of the present invention is not intended to be limited to use in a roof truss. For example, referring to FIG. 11, the structural section of the present invention is shown being used as bottom and top chords 25*a* and 25*b* in a floor truss. Similarly in FIG. 12, the structural section is shown used as a bottom and top header chord 26*a* and 26*b* over a window opening. FIG. 13 shows the structural section adapted for use as a framing track 27 and a stud 28 for residential or light commercial framing. Framing track 27 includes vertical legs

12*a* and 12*b* similar to the vertical legs shown in FIG. 1. However, in this instance distance D3 is greater than the length of the vertical legs 12*a* and 12*b*.

As heretofore disclosed, the inward pointing flanges 16 of the present invention, in combination with the gap "G2," overcomes many of the problems of prior structural sections used in residential framing. For example, in order to insure proper alignment and good truss chord-to-web connections, past designers have provided tight hemmed ends as shown in FIG. 6, the Dry patent, and the DALE/INCOR brochure. "Table A" shown below lists data developed during axial compression tests conducted on three different, structural sections. Each section was 3" tall and 1½" wide. The test specimens included a truss chord having a flanged section according to the preferred embodiment of the invention shown in FIG. 1, a hemmed section as shown in FIG. 6 and the Dry patent, and a simple "U" shaped section (not shown) that comprised a shape having a horizontal segment and two spaced apart legs that had no stiffening means added such as hems or flanges. The simple "U" shaped test sections were formed from 12"×7½" wide strips of 20 gauge and 22 gauge sheet steel, the hemmed sections were formed from 12"× 8.625" wide strips of 20 and 22 gauge steel, and the flanged sections were formed using 12"×9.875" wide strips of 20 and 22 gauge sheet steel. Three 20 gauge sections and three 22 gauge sections were tested for each of the three different shapes, and the tests were conducted in accordance with accepted AISI standard *"Stub Column Test Method for Effective Area of Cold Formed Steel Columns."*

The test data in "Table A" clearly shows that the inward pointing flanges 16 of the present invention greatly improve section properties over hemmed, state-of-the-art truss chords taught by Dry and Dale. Referring to the test results, the three recorded ultimate loads for each test series were averaged and then divided by linear inches of material used to form the shape to determine the efficiency of the shape (see Average Load (lb.)/Linear inches). It was discovered that the hemmed shape is less efficient than the simple "U" shape having no stiffening hems or flanges. It was also discovered that the flanged shape of the present invention is over two times more efficient than the hemmed shape.

TABLE A

| CHORD SECTION THICKNESS | LOAD (lb.) Simple "U" Shape (7.5") | LOAD (lb.) Hemmed Shape (8.625") | LOAD (lb.) Flanged Shape (9.875") |
|---|---|---|---|
| 22 Gauge. (0297") | 3300 | 3550 | 8500 |
| " | 3300 | 3450 | 8500 |
| " | 3400 | 3800 | 9000 |
| Average Load (lb.)/ Linear inches | 444 | 417 | 878 |
| 20 Gauge (0.0344") | 5200 | 5700 | 14700 |
| " | 5250 | 5400 | 13100 |
| " | 5350 | 5400 | 13800 |
| Average Load (lb.)/ Linear inches | 702 | 638 | 1404 |

What is claimed is:

1. A structural section comprising:

a) a first leg and a second leg spaced apart from said first leg and connected thereto by a horizontal segment, said first leg and said second leg each comprising;

i) a first end portion attached to said horizontal segment;

ii) a second end portion opposite said first end portion, said second end portion including an inboard extending flange in combination with a stiffener member attached along one edge thereof, said stiffener member extending downward at an oblique angle from said inboard extending flange, said stiffener member inboard from said second end portion; and iii) a longitudinal clamping surface extending along said first leg and a longitudinal clamping surface extending along said second leg between said first end portion and said second end portion, each said longitudinal clamping surface positioned inboard of said stiffener member so that a distance (D2) between said longitudinal clamping surfaces is less than a distance (D3) between said stiffener members.

2. The invention recited in claim 1 wherein each said stiffener member is slanted toward said longitudinal clamping surface.

3. The invention recited in claim 1 wherein each said stiffener member is slanted away from said longitudinal clamping surface.

4. The invention recited in claim 1 wherein said stiffener member is a curvilinear stiffener member extending downward from said flange edge, said curvilinear stiffener member including a planar leg parallel to and spaced apart from said flange to provide a gap therebetween.

5. The invention recited in claim 1 wherein:

a) said distance (D2) between the longitudinal clamping surface of said first leg and the longitudinal clamping surface of said second leg is predetermined so that said longitudinal surfaces engage a strut inserted therebetween, and b) said stiffener member is positioned to provide a gap between said strut and said stiffener member.

6. The invention recited in claim 5 wherein each said longitudinal clamping surface is fastened to said strut inserted between said first leg and said second leg, each said longitudinal clamping surface being positioned to locate fasteners inboard of said first leg and inboard of said second leg.

7. The invention recited in claim 1 wherein said first leg and said second leg are longer than said horizontal segment.

8. A roof truss constructed with the structural section of claim 1, wherein said roof truss comprises:

a) a top chord member comprising said structural section;

b) a bottom chord member comprising said structural section; and c) a plurality of truss web members extending between said top chord member and said bottom chord member, each said truss web member having an outside dimension equal to said distance (D2).

9. The roof truss recited in claim 8 including:

a) a first gap extending between said oblique stiffener member of said first leg and each truss web member extending between said top chord and said bottom chord; and b) a second gap extending between said oblique stiffener member of said second leg and each truss web member extending between said top chord and said bottom chord.

10. The roof truss recited in claim 9 wherein each said longitudinal clamping surface is fastened to each truss web inserted therebetween.

11. A roof truss constructed with the structural section of claim 4, wherein said roof truss comprises:

a) a top chord member comprising said structural section;

b) a bottom chord member comprising said structural section; and c) a plurality of truss web members extending between said top chord member and said bottom chord member, each said truss web member having an outside dimension equal to said distance (D2).

12. The roof truss recited in claim 11 including:

a) a first gap extending between said curvilinear stiffener member of said first leg and each truss web member extending between said top chord and said bottom chord; and b) a second gap extending between said curvilinear stiffener member of said second leg and each truss web member extending between said top chord and said bottom chord.

13. The roof truss recited in claim 12 wherein each said longitudinal clamping surface is fastened to each truss web inserted therebetween.

14. A floor truss including at least one structural section according to claim 1 as a chord member of the floor truss.

15. A floor truss including at least one structural section according to claim 4 as a chord member of the floor truss.

16. A wall assembly including the structural section according to claim 1 as a track member or a stud member.

17. A wall assembly including the structural section according to claim 4 as a track member or a stud member.

18. A header assembly including at least one structural section according to claim 1 as a chord member.

19. A header assembly including at least one structural section according to claim 4 as a chord member.

20. The header assembly according to claim 18 wherein said structural section provides a top chord and bottom chord in a header over a window opening.

21. The header assembly according to claim 19 wherein said structural section provides a top chord and bottom chord in a header over a window opening.

22. In a roof truss including a top roof truss chord, a bottom roof truss chord, and a plurality of web members extending between the top and bottom roof truss chords, an improved roof truss wherein said top roof truss chord and said bottom roof truss chord each comprise:

a) a first vertical leg spaced apart from a second vertical leg and connected thereto by a horizontal member, each vertical leg including;

i) a first end portion attached to said horizontal member and a second end portion opposite said first end portion;

ii) a clamping surface parallel to and positioned inboard of said vertical leg whereby said clamping surface of said first vertical leg is spaced apart from said clamping surface of said second vertical leg a distance (D2) so that the spaced apart clamping surfaces engage said plurality of web members extending between said top roof truss chord and said bottom roof truss chord;

iii) a flange attached to and extending inboard from said second end portion of said vertical leg, said flange including a stiffener extending at an oblique angle from said flange whereby said stiffener of said first vertical leg is spaced apart from said stiffener of said second vertical leg a distance (D3) greater than distance (D2) so that each said stiffener is positioned proximate said plurality of web members to provided a gap between said stiffener and each web member.

23. The invention recited in claim 22 wherein said distance (D3) is greater than the length of said vertical leg.

24. The invention recited in claim 22 wherein each said oblique angled stiffener is slanted toward said clamping surface.

25. The invention recited in claim 22 wherein each said oblique angled stiffener is slanted away from said clamping surface.

26. The invention recited in claim 22 wherein said stiffener member is curvilinear, each curvilinear stiffener including a planar leg parallel to and spaced apart from said flange to provide a gap between said planar leg and said flange.

27. The invention recited in claim 22 wherein each web member is fastened to said spaced apart clamping surfaces.

28. In a structural section comprising a first leg, and a second leg spaced apart from said first leg and attached thereto by a horizontal segment, said first leg and said second leg each including a first end portion attached to said horizontal segment, a second end portion opposite said first end portion, and a longitudinal clamping surface located between said first end portion and said second end portion, said longitudinal clamping surface positioned inboard of said second end portion, the improvement comprising:

flanges extending inward from said second end portions in combination with stiffeners attached along an edge of said flanges, said stiffeners extending downward at an oblique angle from said flanges, said stiffeners spaced apart a distance (D3) greater than a distance (D2) between said clamping surfaces.

29. The invention recited in claim 28 wherein each said oblique angled stiffener is slanted toward said clamping surface.

30. The invention recited in claim 28 wherein each said oblique angled stiffener is slanted away from said clamping surface.

31. The invention recited in claim 28 wherein said stiffener member is curvilinear, each curvilinear stiffener including a planar leg parallel to and spaced apart from said flange to provide a gap between said planar leg and said flange.

32. The invention recited in claim 28 wherein each web member is fastened to said spaced apart clamping surfaces.

* * * * *